US008893803B1

(12) United States Patent
Lugo

(10) Patent No.: US 8,893,803 B1
(45) Date of Patent: Nov. 25, 2014

(54) SAFETY RELIEF VALVE SYSTEM FOR USE WITH SUBSEA PIPING AND PROCESS FOR PREVENTING OVERPRESSURES FROM AFFECTING THE SUBSEA PIPING

(75) Inventor: Mario R. Lugo, Houston, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 193 days.

(21) Appl. No.: 13/489,773

(22) Filed: Jun. 6, 2012

Related U.S. Application Data

(60) Provisional application No. 61/508,297, filed on Jul. 15, 2011.

(51) Int. Cl.
*E21B 33/035* (2006.01)
*E21B 34/04* (2006.01)

(52) U.S. Cl.
CPC ..... *E21B 33/035* (2013.01); *E21B 34/04* (2013.01)
USPC ..... 166/364; 166/345; 166/347; 166/368; 166/250.01

(58) Field of Classification Search
CPC .... E21B 33/035; E21B 33/0355; E21B 34/04
USPC ..... 166/364, 345, 347, 368, 373, 316, 166/250.01
See application file for complete search history.

(56) References Cited

U.S. PATENT DOCUMENTS 3,788,341 A * 1/1974 Athy et al. ..... 137/209
3,977,423 A * 8/1976 Clayton ..... 137/12
4,200,116 A 4/1980 Gemignani
4,319,603 A * 3/1982 Snyder ..... 137/492.5
4,747,853 A * 5/1988 Haslett et al. ..... 95/22
5,063,956 A 11/1991 Borcuch et al.
6,880,567 B2 * 4/2005 Klaver et al. ..... 137/487.5
7,044,156 B2 * 5/2006 Webster ..... 137/488
7,284,563 B2 10/2007 Partridge et al.
7,793,725 B2 * 9/2010 Daniel et al. ..... 166/366
7,798,233 B2 * 9/2010 Daniel et al. ..... 166/363
7,823,640 B2 * 11/2010 Flanders ..... 166/250.01
7,905,251 B2 * 3/2011 Flanders ..... 137/601.14
7,938,189 B2 * 5/2011 Rytlewski ..... 166/337
8,051,875 B2 * 11/2011 Edwards ..... 137/461
2005/0199286 A1 * 9/2005 Appleford et al. ..... 137/487.5
2007/0095401 A1 * 5/2007 Webster ..... 137/488
2008/0000529 A1 * 1/2008 Lawrence Edwards ..... 137/455
2010/0071775 A1 * 3/2010 Ratcliffe ..... 137/12
2011/0240157 A1 * 10/2011 Jones et al. ..... 137/613
2012/0273209 A1 * 11/2012 Austin et al. ..... 166/321
2012/0273220 A1 * 11/2012 Ezekiel et al. ..... 166/360

* cited by examiner

*Primary Examiner* — Matthew Buck
(74) *Attorney, Agent, or Firm* — Egbert Law Offices, PLLC

(57) ABSTRACT

A subsea relief valve system for use in a subsea environment has subsea piping having a first portion and a second portion, a choke cooperative with the subsea piping and movable between an open position and a closed position, a hydraulic actuator connected to the choke so as to move the choke between the open and closed positions, and a signal source cooperative with the hydraulic actuator so as to actuate the choke to the open position when an overpressure condition is detected. The open position of the choke is suitable for venting a fluid to the subsea environment. The closed position of the choke is suitable for retaining the fluid within the subsea piping.

7 Claims, 2 Drawing Sheets

SAFETY RELIEF VALVE SYSTEM FOR USE WITH SUBSEA PIPING AND PROCESS FOR PREVENTING OVERPRESSURES FROM AFFECTING THE SUBSEA PIPING

RELATED U.S. APPLICATIONS

The present application claims priority from U.S. Provisional Patent Application No. 61/508,297, filed on Jul. 15, 2011, and entitled "Safety Relief Valve For Subsea Piping".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to piping in association with subsea oil and gas production. More particularly, the present invention the relates to safety relief valves and processes which serve to avoid the application of excessive pressures within subsea piping. Additionally, the present invention relates to safety relief valves and processes that are directly associated with the chokes associated with subsea piping so as to effectively release excess pressures.

2. Description of Related Art Including Information Disclosed Under 37 CFR 1.97 and 37 CFR 1.98.

Subsea system are usually designed to work across high pressure differentials (e.g., full wellhead shut-in pressure versus operating flow pressure) even when normal operating flow pressure is only a small fraction of full wellhead shut-in pressure, which dramatically increases project capital expenditures. Subsea systems can comprise protection systems to deal with occasional high pressure differentials, for example, by retaining high pressure within a section of the system capable of withstanding the pressure, which prevents the remainder of the system from being exposed to pressure which may exceed its pressure rating. Thus, the protection systems safeguard equipment of the subsea system as well as maintain safe operation of the subsea system, by protecting the equipment from excessive pressure (e.g., pressure exceeding its pressure rating) that might compromise the operation of the equipment.

In the oil and gas industry, production fluid pipelines downstream of the wellhead are generally thin-walled in order to minimize the cost of the pipeline. It is therefore necessary that such pipelines be protected against excessive pressure that might rupture the pipe, which would be very expensive to replace and cause environmental pollution. A conventional system used to protect pipelines from over-pressure is the high integrity protection system (HIPS). This is typically an electro-hydraulic system employing pressure sensors to measure the pressure in the pipes which are used through the electronics of a control module to control the closure of a production pipe HIPS valve. This arrangement retains the high pressure within a short section of pipeline between the production tree and the HIPS valve which is capable of withstanding the pressure. This prevents the main, thinner-walled section of the pipeline from being exposed to pressure levels which may exceed the pipeline's pressure rating.

Unfortunately, such HIPS systems are essentially in the nature of an on/off switch. This is a very complicated system and acts as a fast response valve. When the system senses the pressure is too high, it simply shuts off the system. If it senses pressure is critical, it will turn off.

Conventional subsea piping also can include a choke. A choke facilitates the ability to pass drilling mud, and other abrasive components, therethrough. The conventional choke is relatively slow. It was movable through a wide variety of positions in a ratcheting fashion. As such, the choke is not very fast acting when it is necessary to accommodate high pressures that may be occurring to the system.

In the past, various patents have issued relating to such safety relief valves. For example, U.S. Pat. No. 3,977,423, issued on Aug. 31, 1976 to A. H. Clayton, describes a valve control apparatus and method. This method serves to control a fluid pressure-actuated valve. The valve has an inlet pressure and an outlet pressure that are applied to control and limit the valve outlet pressure and to substantially reduce the fluid pressure applied to the valve actuating means when the valve inlet pressure is below a preselected safe value.

U.S. Pat. No. 4,200,116, issued on Apr. 29, 1980 to F. Gemignani, describes a device for sensing pressure and governing the operation of safety valves. This control device comprises a pair of chambers, each connected to the vessel to be protected and provided with respective valves. The first chamber is connected also to the cylinder of the safety valve via the first valve so that, when an excessive pressure in the vessel develops, the first chamber closes the connection between the vessel and the control cylinder while the second chamber vents the control cylinder to the atmosphere.

U.S. Pat. No. 4,747,853, issued on May 31, 1988 to Haslett et al., discloses a pressure control arrangement for a fluid line in a system. This pressure control arrangement has a normally open valve, a flow restricting member, and a pressure sensor disposed in the fluid line. The pressure sensor is disposed upstream of the flow restricting member and is arranged to sense the pressure in the line and to actuate the valve to close the line in the event of the sensed pressure exceeding a predetermined limit. The predetermined limit is above the normal operating pressure range of the fluid line but below the maximum overpressure to which there is a risk of the line being subject. The portion of the fluid line upstream of the flow restricting member is constructed to have a maximum design pressure at least equal to the maximum overpressure.

U.S. Pat. No. 5,063,956, issued on Nov. 12, 1991 to Borcuch et al., discloses a fluid delivery pressure control system to maintain a set delivery pressure at varying demand. The system includes a fluid-loaded, self-operated main regulator. The system includes a flow restrictor for metering the loading fluid flow, a back-pressure regulator for controlling the loading fluid pressure, and a temperature-actuated regulator for venting loading fluid when the process fluid temperature varies from a selected range.

U.S. Pat. No. 7,044,156, issued on May 16, 2006 to D. Webster, describes a pipeline protection system that comprises a hydraulically-actuated valve operable to switchably prevent a flow of fluid from a first section of the pipeline to a second section of the pipeline. There is a hydraulic fluid source for supplying hydraulic fluid to the hydraulically-actuated valve to enable actuation thereof. A vent is provided for venting hydraulic fluid from the hydraulically-actuated valve. The hydraulically-actuated valve is connected to the vent via a differential pressure valve to control venting of the hydraulically-actuated valve. A pressure transfer barrier with a first port is connected to the first section of the pipeline and a second port is connected to the differential pressure valve.

The differential pressure valve is supplied with hydraulic fluid at a reference pressure. If the pressure of fluid in the first section of pipeline exceeds the reference pressure of the hydraulic fluid supplied to the differential pressure valve, the differential pressure valve is caused to be in an open state, thereby causing the hydraulic pressure in the hydraulically-actuated valve to be released via the vent.

U.S. Pat. No. 7,284,563, issued on Oct. 23, 2007 to Partridge et al., describes a surge relief apparatus for sensing, tracking and responding to pressure changes in a flow system. The apparatus includes a fluid storage tank that is in fluid communication with the flow system. The apparatus also includes a control valve that is connected to the fluid storage tank. The control valve compensates for pressure in response to pressure change in the flow system. The control valve also controls the rate of pipeline pressure rise in the flow system. The surge relief apparatus also includes a hydraulic accumulator in fluid communication with the control valve along with a surge relief valve in fluid communication with the accumulator.

U.S. Pat. No. 7,905,251, issued on Mar. 15, 2011 to S. F. Flanders, teaches a high integrity protection system for protection of a pipe downstream of a wellhead. There is an inlet connected to the wellhead and an outlet connected to the downstream pipe. Two sets of two series-connected surface safety valves are in fluid communication with the inlet and outlet. The sets are in parallel fluid flow relation to each other. Either one or both of the sets of surface safety valves are operable as a flowpath for fluids entering the inlet and passing through the outlet to the downstream pipe. Two vent control valves are connected to piping intermediate one set of series-connected surface safety valves. The vent control valves are in fluid communication with a vent line. Upon opening of a vent control valve, a process pressure between the surface safety valves is vented.

U.S. Patent publication No. 2010/0071775, published on Mar. 25, 2010 to A. J. Ratcliffe, describes a subsea system and method for protecting equipment of a subsea system. This subsea system has a wellbore within a reservoir. Equipment is located downstream of the wellbore. A barrier is connected to the equipment. The equipment is rated for a maximum pressure that is less than a maximum reservoir pressure and equal to or greater than the maximum reservoir pressure less external hydrostatic pressure experienced by the equipment. The barrier is rated for a maximum pressure that is equal to or greater than the maximum reservoir pressure.

It is an object of the present invention to provide a safety relief valve that effectively avoids equipment damage to the subsea equipment.

It is another object of the present invention to provide a safety relief valve apparatus that enhances vessel safety.

It is still another object of the present invention to provide a safety relief valve for subsea equipment that minimizes hydrocarbon release in the subsea environment.

It is still a further object of the present invention to provide a safety relief valve for use with subsea equipment that can effectively avoid underground blowouts and other disastrous equipment.

These and other objects and advantages of the present invention will become apparent from a reading of the attached specification and appended claims.

BRIEF SUMMARY OF THE INVENTION

The present invention is a safety relief valve assembly for use with a choke associated with subsea piping. In particular, the subsea piping can be in the nature of a blowout preventor, a capping stack, a Christmas tree, a manifold and other equipment. The present invention is particularly applicable when placed in association with piping that has varying capacity ratings. For example, if one component of the subsea piping has a lower capacity rating downstream of another piece of equipment, the present invention acts on the choke so as to release pressure so that overpressure conditions are avoided.

In particular, the choke of the present invention is suitable for venting pressure and hydrocarbons to the sea in the event of an overpressure condition. The choke is movable between an open position and a closed position. In the open position, the choke will vent to the subsea environment. In the closed position, the choke will retain the fluid therein.

A hydraulic actuator is connected to the choke. This hydraulic actuator has a cylinder with a piston slidably positioned therein. The cylinder and the piston define a first chamber located on one side of the piston and a second chamber located on an opposite side of the piston.

A first hydraulic line is connected to the cylinder so as to communicate with the first chamber in the cylinder. A second hydraulic line is connected to the cylinder so as to communicate with the second chamber. A hydraulic supply is connected to the first and second lines. This hydraulic supply can be in the nature of an accumulator bottle.

A first valve is positioned on the first hydraulic line. This first valve opens so as to pass hydraulic fluid toward the first chamber of the hydraulic actuator. The first valve is closable so as to block hydraulic fluid from entering the chamber and allow fluid to bleed outwardly of the first chamber. The first valve is operatively connected to a signal source located at the surface of water. The first valve can be opened when the pressures in the subsea piping are within desired limits. As such, the choke will be closed and no pressure will vent to the subsea environment.

A second valve is positioned on the second hydraulic line. This second valve is openable so as to pass hydraulic fluid to the second chamber. The second valve is closable so as to block fluid from entering the chamber and to allow hydraulic fluid to bleed out of the second chamber. The second valve is operatively connected to a signal source cooperative with the pressure in the subsea piping adjacent to the choke. The second valve will be opened when pressures exceed a predetermined limit. As such, the choke will vent the excess pressure to the sea so as to avoid damage to the subsea piping.

The present invention is also a process for preventing overpressures from affecting a portion of subsea piping in a subsea environment in which the subsea piping has another portion with a pressure rating greater than a pressure rating of the portion. The process includes the steps of: (1) connecting a choke to the another portion of the subsea piping; (2) sensing a pressure of the fluid in at least one of the portions of the subsea piping; (3) moving the choke to the open position when the sensed pressure is greater than the pressure rating in one of the portions; and (4) venting the fluid to the subsea environment. The choke has an open position and a closed position. The open position is suitable for opening to the subsea environment. The closed position is suitable for blocking fluid from the subsea environment.

The process of the present invention also includes the steps of connecting a hydraulic actuator to the choke and actuating the actuator so as to move the choke from the closed position to the open position. The hydraulic actuator has a cylinder with a piston therein. The piston defines a first chamber and a second chamber within the cylinder. The step of actuating includes introducing a hydraulic fluid into one of the chambers so as to move the piston in a direction suitable for opening the choke. A hydraulic line is connected to the cylinder and to a hydraulic fluid supply. The hydraulic line communicates with the chamber. The hydraulic fluid is passed along the hydraulic line from the hydraulic fluid supply to the chamber.

The process of the present invention further includes the step of affixing a valve along the hydraulic line, transmitting a signal to the valve when the second pressure is greater than the rated pressure, and actuating the valve such that the hydraulic fluid passes into the chamber of the cylinder of the hydraulic actuator so as to cause the hydraulic actuator to move the choke to the open position.

The choke is moved to the closed position when the sensed pressure is less than the pressure rating of the portion of the subsea piping.

DETAILED DESCRIPTION OF THE INVENTION

Figure 1:
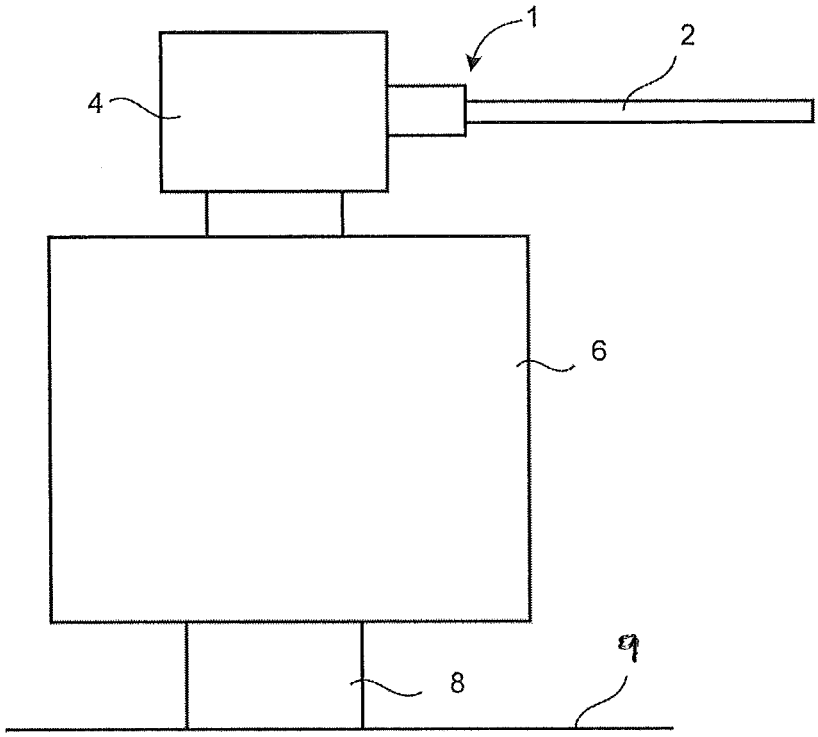
FIG. 1 is an illustration of the safety relief valve of the present invention as used in association with the a capping stack associated with a blowout preventor.

Referring to FIG. 1, there is shown the safety relief valve system 1 of the present invention as used in association with piping 2 and connected to a capping stack 14 associated with a blowout preventor 6. The production piping 8 is connected to the blowout preventor 16 and extends downwardly into the floor 9 of the subsea formation.

1. The safety relief valve 1 of the present invention is particularly applicable in those circumstances in which the pressure rating of the piping 2 is lower than the pressure rating of the capping stack 4. For example, if the capping stack 4 has a weighted pressure of 15,000 p.s.i. and the piping 2 has a weighted pressure of 10,000 p.s.i., then it is important to be able to avoid the transmission of such high pressures of the capping stack into the piping 2. In the event the pressure in the capping stack 4 should exceed 10,000 p.s.i., the safety relief valve 1 will suitably open so as to vent pressure from the capping stack 4 so as to prevent excessive pressures from flowing through the subsea piping 2. Additionally, and furthermore, if pressures within the capping stack 4 should exceed the pressure rating of the capping stack 4, then the safety relief valve 1 of the present invention can also suitably open so that the choke associated therewith will vent pressure to the subsea environment and prevent potentially damaging pressures from adversely affecting the capping stack 4. Within the concept of the present invention, the safety relief valve 1 can be associated with various other components of subsea environment, such as a blowout preventor 6, the capping stack 4, a Christmas tree, a manifold, and other components.

Figure 2:
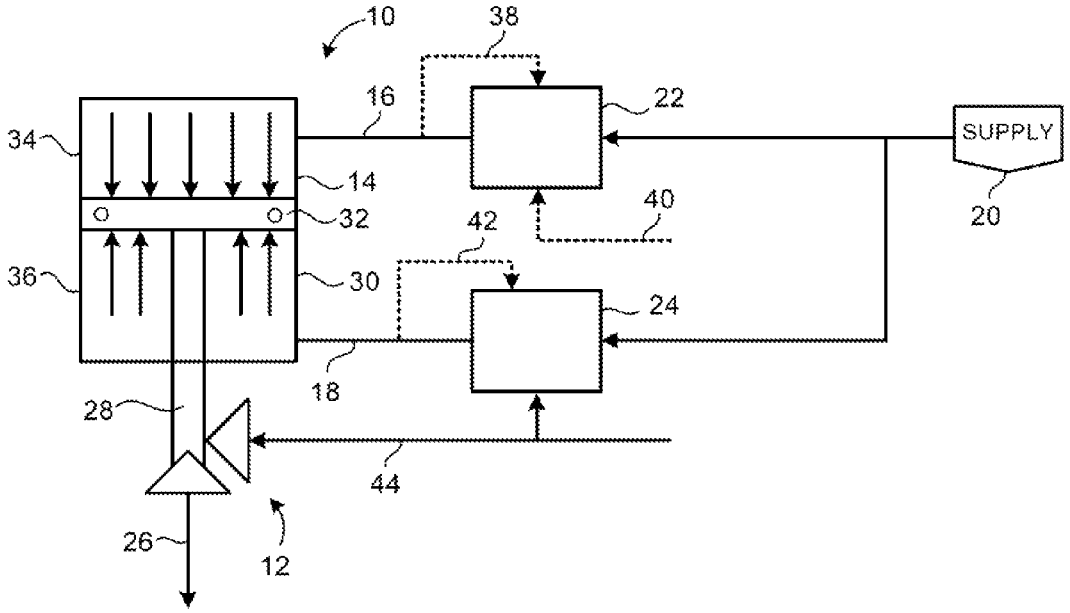
FIG. 2 is a block diagram that is illustrative of the safety relief valve of the present invention and illustrates the operation of such safety relief valve.

FIG. 2 is a detailed illustration of the safety relief valve 10 of the present invention. In particular, the safety relief valve 10 of the present invention includes a choke 12, a hydraulic actuator 14, a first hydraulic line 16, a second hydraulic line 18, a hydraulic supply 20, a first valve 22 and a second valve 24.

As can be seen in FIG. 2, the choke 12 includes an opening that allows the choke 12 to vent excess pressure 26 to the sea. The choke 12 is operative connected by a shaft 28 to the hydraulic actuator 14. As in the nature of conventional chokes, the choke is adjustably movable between an open position and a closed position. The open position will vent the pressure to the subsea environment. The closed position will retain the fluid.

The hydraulic actuator 14 has a cylinder 30 and a piston 32 slidable positioned within the cylinder 30. The piston 32, along with the cylinder 30 define a first chamber 34 located on side of the piston 32 and the chamber 36 located on a opposite side of the piston 32.

The first hydraulic line 16 is connected to the cylinder 30 so as to communicate with the first chamber 32 in the hydraulic actuator 14. The second hydraulic line 18 is connected the cylinder 30 so as to communicate with the second chamber 36 within the hydraulic actuator 14. The arrows illustrated in FIG. 2 show the potential movement of the piston 32 upwardly and downwardly within the cylinder 30 based upon the hydraulic pressures that are introduced by either of the hydraulic lines 16 and 18.

The hydraulic supply 20 is connected to the first hydraulic line 16 and the second hydraulic line 18. The hydraulic supply 20 can be in the nature of an accumulator bottle that resides adjacent to the subsea piping assembly.

The first valve 22 is positioned on the first hydraulic line 16. The first valve 22 opens so as to allow hydraulic fluid to pass through the first hydraulic line 16 toward the first chamber 34. The valve 22 is closable so as to block hydraulic fluid from entering the chamber 34 and the allow the fluid to bleed outwardly of the first chamber 34. Broken line 38 illustrates the bleed pathway of the hydraulic fluid. The first valve 22 is operative connected to a signal source 40 located at the surface of the body of water. The first valve 22 can open when pressures in the subsea piping are within a desired limit. As such, the choke 12 will be closed so as to prevent pressure from seeping therefrom. The monitor of pressures and the opening and closing of the valve 22 can be monitored at the surface location.

The second valve 24 is positioned on the second hydraulic line 18. The second valve 24 opens so as to pass hydraulic fluid to the second chamber 36 of the hydraulic actuator 14. The second valve 24 closes so as to block hydraulic fluid from entering the second chamber 36 and allow the hydraulic fluid therein to bleed outwardly therefrom along bleed line 42. The second valve 24 is operatively connected to a signal source 44 cooperative with a pressure sensor in the subsea piping at the choke 12. The piston 32 will move upwardly so as to open the choke 12 when the pressure in the subsea piping exceeds a predetermined limit.

The foregoing disclosure and description of the invention is illustrative and explanatory thereof. Various changes in the details of the described system or in the steps of the describes method can be made without departing from the true spirit of the invention. The present invention should only be limited by the following claims and their legal equivalents.

I claim:

1. A subsea relief valve system for use in a subsea environment, the subsea relief valve system comprising:

a subsea piping having a first portion and a second portion, said first portion having a higher pressure rating than a pressure rating of said second portion;

a choke cooperative with said subsea piping, said choke being movable between an open position and a closed position, said open position suitable for venting a fluid to the subsea environment when a pressure of a fluid in said first portion of said subsea piping exceeds the pressure rating of said second portion of said subsea piping, said closed position suitable for retaining the fluid in the subsea piping;

a hydraulic actuator connected to said choke so as to move said choke between said closed position and said open position, said hydraulic actuator comprising:

a cylinder; and a piston slidably positioned in said cylinder, said piston operatively connected to said choke, said piston defining a first chamber and a second chamber within said cylinder; and a first hydraulic line connected to said cylinder so as to be in communication with said first chamber;

a hydraulic fluid supply in communication with said first hydraulic line;

a first valve positioned between said hydraulic fluid supply and said first chamber, said first valve movable between an open position and a closed position, said open position of said valve allowing hydraulic fluid to pass from said hydraulic fluid supply through said first hydraulic line to said first chamber of said cylinder, said closed position of said first valve blocking hydraulic fluid from passing from said hydraulic fluid supply to said first chamber of said cylinder; and a sensor cooperating with said first portion of said piping so as to sense a pressure of the fluid in said first portion of said piping; and a controller cooperative with said sensor and with said first valve so as to move said first valve to said open position when the pressure of the fluid in said first portion of said piping exceeds the pressure rating of said second portion of said piping so that said piston moves said choke to said open position.

2. The subsea relief valve system of claim 1, said hydraulic actuator further comprising:

a second valve positioned on a second hydraulic line, said second valve having an open position and a closed position, said open position of said second valve allowing hydraulic fluid to pass to said second chamber, said closed position of said second valve blocking hydraulic fluid from passing through said second hydraulic line to said second chamber.

3. The subsea relief valve system of claim 2, said closed position of said first valve causing said hydraulic fluid in said first chamber to bleed outwardly therefrom, said closed position of said second valve causing fluid in said second chamber to bleed outwardly therefrom.

4. The subsea relief valve system of claim 2, said first and second valves being cooperative with said a signal source so as to be actuated from a remote location.

5. The subsea relief valve system of claim 1, said hydraulic fluid supply being an accumulator bottle.

6. The subsea relief valve system of claim 1, said subsea piping selected from the group of consisting of a blowout preventor, a capping stack, a Christmas tree, and a manifold.

7. A process for preventing fluid overpressures in a subsea piping system in which the subsea piping has a first portion with a pressure rating greater than the pressure rating of a second portion of the subsea piping system, the process comprising:

connecting a choke to the second portion of the subsea piping system, said choke having an open position and a closed position, said open position opening to a subsea environment, said closed position retaining the fluid in the subsea piping system;

connecting a hydraulic actuator to said choke, said hydraulic actuator having a cylinder with a piston slidably positioned in said cylinder, said piston operatively connected to said choke, said piston defining a first chamber and a second chamber within said cylinder;

connecting a first hydraulic line to said first chamber of said cylinder, said first hydraulic line having a valve cooperative therewith, said valve movable between an open position and a closed position;

connecting a hydraulic fluid supply to said first hydraulic line;

sensing a fluid pressure in said first portion of said subsea piping system;

moving said valve of said first hydraulic line to said open position when the sensed fluid pressure is greater than the pressure rating of said second portion of said subsea piping system such that the hydraulic fluid flows through said first hydraulic line to said first chamber of said cylinder to move said piston so as to move said choke to said open position;

venting the fluid in said subsea piping system to the subsea environment.

* * * * *